US009328522B2

(12) United States Patent
Bordin

(10) Patent No.: US 9,328,522 B2
(45) Date of Patent: May 3, 2016

(54) LEVELING SPACER FOR LAYING TILES, FLOOR TILES AND THE LIKE WITH THE INTERPOSITION OF GAPS

(71) Applicant: PROGRESS PROFILES SPA, Asolo (IT)

(72) Inventor: Lino Bordin, Maser (IT)

(73) Assignee: PROGRESS PROFILES SPA (IT)

( * ) Notice: Subject to any disclaimer, the term of this patent is extended or adjusted under 35 U.S.C. 154(b) by 0 days.

(21) Appl. No.: 14/729,861

(22) Filed: Jun. 3, 2015

(65) Prior Publication Data

US 2015/0354231 A1 Dec. 10, 2015

(30) Foreign Application Priority Data

Jun. 4, 2014 (IT) ..... PD2014A0136

(51) Int. Cl.

| | |
|---|---|
| ***E04B 2/82*** | (2006.01) |
| ***E04B 9/00*** | (2006.01) |
| ***E04G 1/22*** | (2006.01) |
| ***E04F 21/20*** | (2006.01) |
| ***E04F 21/00*** | (2006.01) |
| *E04F 13/08* | (2006.01) |
| *E04F 15/02* | (2006.01) |
| *E04F 21/18* | (2006.01) |

(52) U.S. Cl.

CPC ..... *E04F 21/20* (2013.01); *E04F 21/0092* (2013.01); *E04F 13/0892* (2013.01); *E04F 15/02022* (2013.01); *E04F 21/1877* (2013.01)

(58) Field of Classification Search

CPC ..... E04F 21/0092; E04F 15/02005; E04F 13/0892; E04F 15/02022; E04F 21/1877

USPC ..... 52/396.1, 126.1, 126.4, 126.7, DIG. 1, 52/391, 747.11, 749.11, 396.08, 390, 389, 52/127.1, 746.12, 127.7; 33/526, 527, 33/567, 567.1, 613, 645; 411/538, 537, 411/546

See application file for complete search history.

(56) References Cited

U.S. PATENT DOCUMENTS

| | | | | |
|---|---|---|---|---|
| 5,875,606 | A * | 3/1999 | Jensen | E04G 23/0203 254/100 |
| 7,257,926 | B1 * | 8/2007 | Kirby | E04F 15/02005 33/526 |
| 8,099,926 | B2 * | 1/2012 | Kufner | E04F 15/02005 33/526 |
| 8,181,420 | B2 * | 5/2012 | Torrents I Comas | E04F 21/0092 52/127.7 |
| 8,635,815 | B2 | 1/2014 | Bordin | |

(Continued)

FOREIGN PATENT DOCUMENTS

| | | | |
|---|---|---|---|
| DE | 102011051428 | A1 | 2/2012 |
| EP | 2549030 | A2 | 1/2013 |
| JP | 2013204318 | A | 10/2013 |

*Primary Examiner* — Chi Q Nguyen
(74) *Attorney, Agent, or Firm* — Cantor Colburn LLP

(57) ABSTRACT

A leveling spacer for laying tiles, floor tiles and the like with the interposition of gaps having a base, a threaded stem, a knob, and a slip preventing element for protecting the tiles between which the spacer is arranged. The base includes spacing protrusions in order to define the width of the gaps. The threaded stem is fixed at right angles to the base by interposition of a stem supporting portion that is connected to the base by means of at least one preweakened point. The knob is configured for gripping and removing by breaking the threaded stem, which includes a female thread portion adapted to be screwed to the threaded stem. The slip preventing element is adapted to be arranged substantially coaxially to the knob, for abutment against the knob on the side of the base.

8 Claims, 2 Drawing Sheets

(56) References Cited

U.S. PATENT DOCUMENTS

2007/0180723 A1* 8/2007 Morgan ..... B21D 28/125
33/645

2015/0267420 A1* 9/2015 Fontana ..... E04F 13/0892
52/126.1

* cited by examiner

LEVELING SPACER FOR LAYING TILES, FLOOR TILES AND THE LIKE WITH THE INTERPOSITION OF GAPS

FIELD

The present disclosure relates to a leveling spacer for laying tiles, floor tiles and like with the interposition of gaps.

BACKGROUND

The laying of tiles and coverings composed of tiles, floor tiles or slabs of medium or large size with reduced or lowered thickness typically is more difficult during the steps for leveling the laying and for equally spacing the tiles in order to provide the gaps.

Leveling spacers are currently known for laying tiles, floor tiles and the like which are constituted by a base, to be arranged below two laterally adjacent tiles; spacing protrusions, shaped substantially like a parallelepiped, extend from such base in order to define the width of the gaps and in fact define the abutments for the edges of the tiles.

By arranging for example two leveling spacers at each side of a tile, preferably proximate to each corner, one obtains for such tile the desired planarity, and at the same time correct placement is sought with respect to the tiles that surround it and also are laid with other identical leveling spacers.

A flat tab protrudes from the base of the leveling spacer, is extended so as to exit from the channel defined between the tiles in order to provide the gap, and is provided with an opening for insertion of a tile locking wedge between the surface of the tile and the upper edge of the opening.

Such wedge-type locking system has two functions: locking the edges of the laterally adjacent tiles between such wedge and the base of the leveling spacer, ensuring co-planner arrangement during the laying of the tiles, removing the tabs of the respective bases for the provision of the gaps by striking the wedge in the direction of insertion in the window of such tab.

Another similar leveling spacer has a toothed strap-like tab that extends from the base with spacers and is preset to be inserted in a locking body, which in turn is adapted to be pressed so as to straddle the two laterally adjacent edges of the nearby tiles.

Such leveling spacers, while being widespread and appreciated, suffer drawbacks, such as actual difficulty in removing the tab by striking the wedge, and the use of an adapted tool to perform the correct and useful coupling between the strap and the locking body in order to lock the tiles between the locking body and the base of the spacer, said use in fact requiring the availability of said tool and a certain time both for placement and for removal.

In order to obviate these drawbacks, a leveling spacer for laying tiles, floor tiles and the like with the interposition of gaps has been devised which is the subject of Italian patent application PD 2011 A 295 by Progress Profiles S.p.A. filed on Sep. 20, 2011.

Such leveling spacer is characterized in that it comprises

- a base with abutment spacing protrusions for the edges of corresponding tiles, in order to define the width of the gaps,
- a threaded stem, which is fixed at right angles to the base in at least one preweakened point,
- a knob for gripping and removing the threaded stem, which comprises a female thread portion that is adapted to be screwed to said threaded stem.

The possibility to screw the knob on the threaded stem allows to adapt the leveling spacer according to the disclosure to tiles, floor tiles and slabs having thicknesses from 3 millimeters up to 30 millimeters, and optionally more, providing an adapted longer stem.

The knob can of course be reused.

The disclosure provides a leveling spacer that is easy and intuitive to use both during assembly for locking the tiles and during removal for the subsequent provision of the gaps, a screwing operation being required and sufficient for both steps.

Such leveling spacer, while being appreciated and advantageous for the reasons described above, has an aspect that can be improved, which is linked to the fact the operation for screwing the knob to the threaded stem entails that the last turns are imparted to the knob when it is in contact with the tiles, for better grip of the spacer to the tiles, with consequent assurance of the planarity among laterally adjacent tiles.

Such rotation of the knob in contact with the tiles can cause a highly unwanted slippage of said tiles, caused by the knob alone or, worse still, if typical building yard debris, such as grains of building material and the like, become interposed between the tile and the knob.

Such phenomenon of tile slippage is even more conspicuous if the knob is screwed on to separate the threaded stem, inevitably entailing an increase in the pressure of said knob on the tiles.

SUMMARY

The aim of the present disclosure is to provide a leveling spacer for laying tiles, floor tiles and the like with the interposition of gaps, that is capable of obviating the drawbacks suffered by leveling spacers of the known type.

Within this aim, an object of the disclosure is to provide a leveling spacer that is easy and intuitive to use both during assembly to lock the tiles and during removal for subsequent filling of the gaps and that furthermore can be used without any damage for the tiles or floor tiles between which it is applied.

Another object of the disclosure is to provide a leveling spacer that can be used without subjecting the tiles to an unwanted lateral thrust that risks affecting their correct placement.

A further object of the disclosure is to provide a leveling spacer that can be used without the aid of specifically provided tools.

This aim, as well as these and other objects that will become better apparent hereinafter, are achieved by a leveling spacer for laying tiles, floor tiles and the like with the interposition of gaps, comprising

- a base with spacing protrusions in order to define the width of the gaps,
- a threaded stem that is fixed at right angles to the base by interposition of a stem supporting portion that is connected to said base by means of at least one preweakened point,
- a knob for gripping and removing by breaking the threaded stem, which comprises a female thread portion adapted to be screwed to said threaded stem, characterized in that it comprises a slip preventing element for protecting the tiles between which the spacer is arranged, adapted to be arranged substantially coaxially to said knob, for abutment against said knob on the side of said base in the configuration for use.

BRIEF DESCRIPTION OF THE DRAWINGS

Further characteristics and advantages of the disclosure will become better apparent from the description of embodiments of the leveling spacer according to the disclosure, illustrated by way of non-limiting example in the accompanying drawings, wherein.

DETAILED DESCRIPTION OF THE DRAWINGS

With reference to the figures, a leveling spacer for laying tiles, floor tiles and like with the interposition of gaps is designated generally by the numeral 10.

Figure 1:
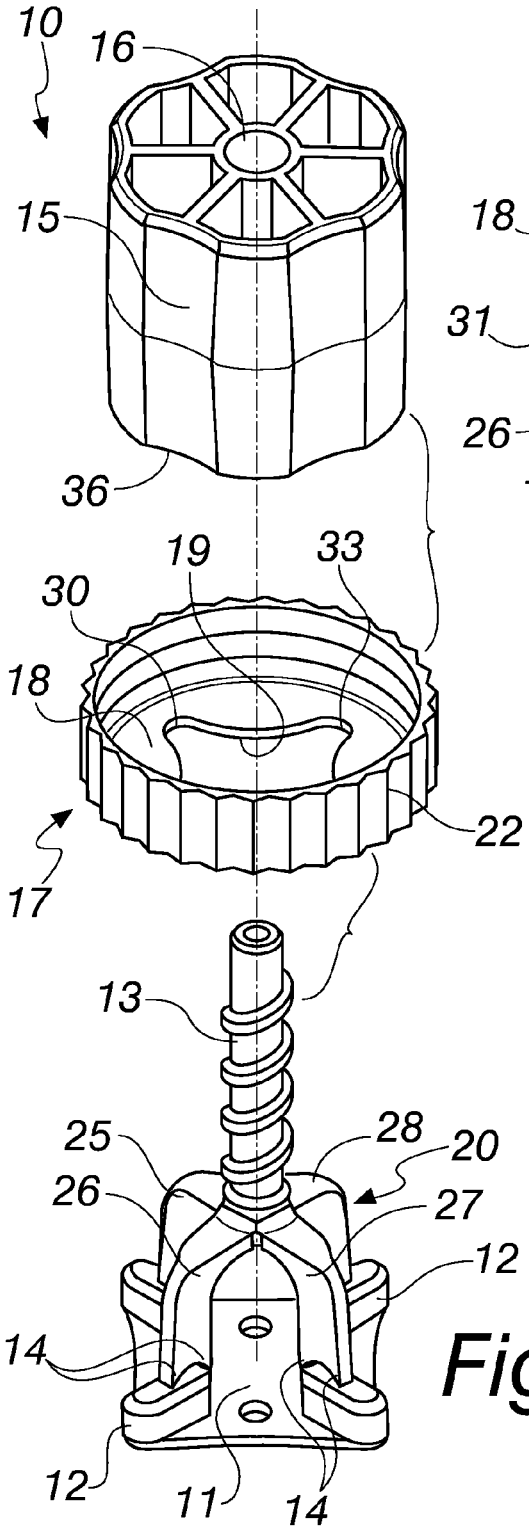
FIG. 1 is an exploded top perspective view of a leveling spacer according to the disclosure.
Figure 2:
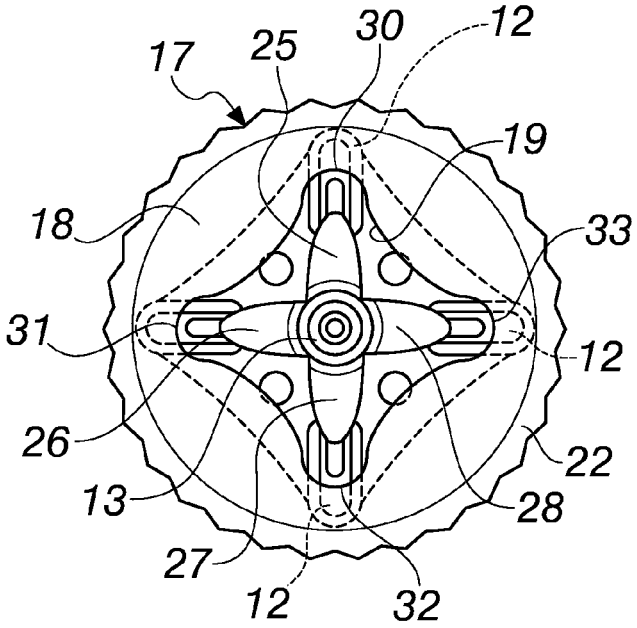
FIG. 2 is a plan view of the slip preventing element coupled to the base with a threaded stem.
Figure 3:
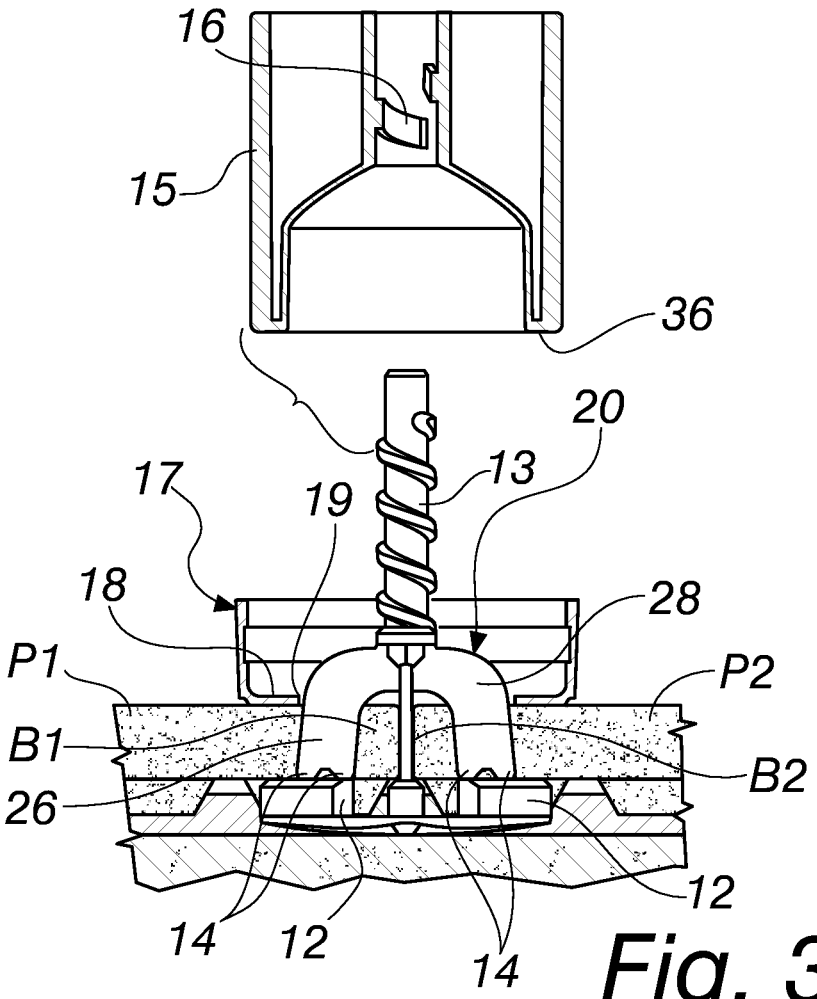
FIG. 3 is a sectional side view of the spacer according to the disclosure in a step of assembly.
Figure 4:
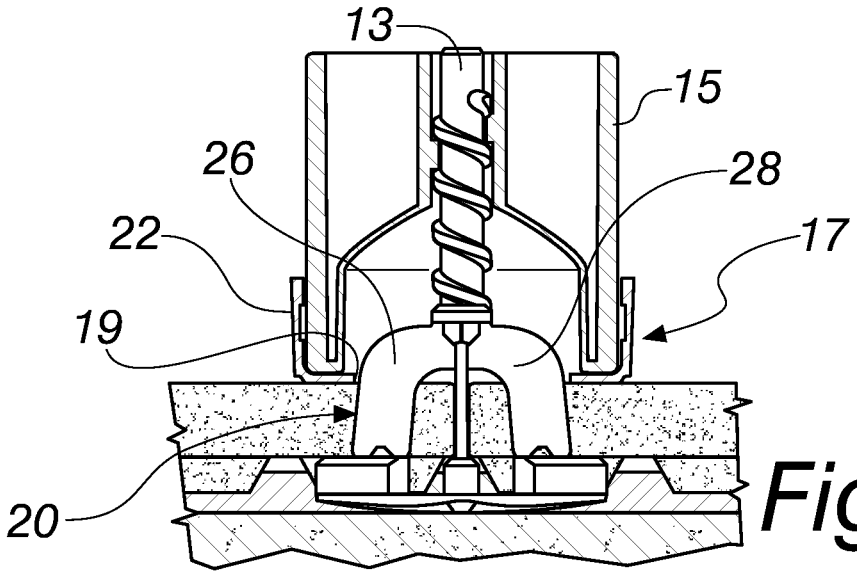
FIG. 4 is a sectional side view of the spacer according to the disclosure in a first step of use.

Two generic tiles, shown schematically in FIGS. 3 and 4, are designated by P1 and P2 and are to be understood as not being the subject matter of the disclosure.

The edges of the tiles P1 and P2 are designated respectively by B1 and B2.

The leveling spacer 10 comprises:

- a base 11 with spacing protrusions 12 arranged in a cross-like arrangement in order to define the width of the gaps,
- a threaded stem 13, which is fixed at right angles to the center of the base 11 by interposition of a stem supporting portion 20 that is connected to the base 11 by means of a plurality of preweakened points 14, which in the present constructive example are constituted by two preweakened points 14 for each spacing protrusion 12,
- a knob 15 for gripping and removing by breaking the threaded stem 13, which comprises a female thread portion 16 adapted to be screwed to said threaded stem 13.

The particularity of the disclosure resides in that it comprises a slip preventing element 17 for protecting the tiles P1 and P2 between which the spacer 10 is arranged.

The slip preventing element 17 is adapted to be arranged substantially coaxially to said knob 15, for abutment against the knob 15 on the side of said base 11 in the configuration for use, as shown clearly in FIGS. 3 and 4.

The slip preventing element 17 is interposed between the knob 15 and the tiles P1 and P2, preventing the slippage of the knob 15 during screwing.

Rotation preventing means are defined between the slip preventing element 17 and the base 11 and are adapted to prevent the rotation of the slip preventing element 17 with respect to the base 11.

The stable position of the slip preventing element 17 with respect to the tiles eliminates the risk of slippage of said tiles during the screwing of the knob 15, said slippage risk occurring at the interface between the slip preventing element 17 and the corresponding face of the knob 15.

In the embodiment of the disclosure described herein by way of non-limiting example of the disclosure, the slip preventing element 17 is constituted by a flat body 18 whose dimensions are such as to affect all the surface regions 36 of the knob 15 that are intended for contact with an underlying tile, at least those intended for resting with lower contact.

An opening 19 is defined on the flat body 18 and is contoured to be coupled to the corresponding stem supporting portion 20 that extends from the base 11.

The rotation preventing means are constituted indeed by said coupling between the opening 19 and the stem supporting portion 20.

The flat body 18 is substantially disk-shaped and has a perimetric centering shoulder 22 for correct placement with respect to the knob 15 in the configuration for use.

In the present non-limiting example of the disclosure, the stem supporting portion 20 comprises a number of arc portions 25, 26, 27, 28 for supporting the threaded stem 13 that matches the number of the spacing protrusions 12, which are four in number in the figures.

Each supporting arc portion 25, 26, 27, 28 protrudes from a corresponding spacing protrusion 12.

Obviously, it is understood that the leveling spacer according to the disclosure can also have three supporting arc portions or two supporting arc portions, depending on the type of tile composition with which it is to be associated.

The opening 19, in order to produce a rotation-preventing coupling with the stem supporting portion 20, is provided with curves 30, 31, 32, 33 that are extended radially and are adapted to surround partially the outer profile each of a corresponding supporting arc portion 25, 26, 27, 28 respectively.

The slip preventing element 17 is made of plastic material or of another similar and equivalent material.

It should be understood that the spacing protrusions 12 can be provided in different widths, for example from 1 to 10 millimeters, in order to define gaps that have the desired width, as well as gaps that have a very small width, close to 1 millimeter, the provision of which usually requires great skill and therefore a long time and talent on the part of the tiler.

The possibility to screw the knob 15 to the threaded stem 13 allows to adapt the leveling spacer 10 according to the disclosure to tiles, floor tiles and slabs having thicknesses from 3 millimeters up to 30 millimeters and optionally more by providing an adapted longer threaded stem.

The base 11 with the spacing protrusions 12 and the threaded stem 13 with the wings 17 are made of a single piece of plastic material.

The knob 15 also can be made advantageously of a single piece of plastic material.

The knob 15 obviously can be reused.

In practice it has been found that the disclosure achieves the intended aim and objects.

In particular, the disclosure provides a leveling spacer that is easy and intuitive to use both in the step of assembly for locking the tiles and in the step of removal for subsequent provision of the gaps, the execution of a screwing operation being necessary and sufficient for both steps.

Furthermore, the disclosure provides a leveling spacer that at the same time offers protection to the tiles in the knob screwing region.

Moreover, the disclosure provides a leveling spacer that can be used without subjecting the tiles to an unwanted lateral thrust that risks conditioning its correct placement by way of the effect of mere compression of the edges of the tiles in a direction at right angles to the arrangement of said tiles, provided by the screwing of the knob 15 on the threaded stem 13.

Furthermore, the disclosure provides a leveling spacer that can be used without the aid of specifically provided tools but by acting only manually by screwing the knob on the threaded stem.

The disclosure thus conceived is susceptible of numerous modifications and variations, all of which are within the scope of the appended claims; all the details may further be replaced with other technically equivalent elements.

In practice, the components and the materials used, as well as the contingent shapes and dimensions, may be any according to requirements and to the state of the art.

The disclosures in Italian Patent Application No. PD2014A000136 from which this application claims priority are incorporated herein by reference.

What is claimed is:

1. A leveling spacer for laying tiles with an interposition of gaps, comprising:

a base with spacing protrusions in order to define a width of gaps, a threaded stem that is fixed at right angles to the base by interposition of a stem supporting portion that is connected to said base by means of at least one preweakened point arranged between said threaded stem and said spacing protrusions, a knob for gripping and removing by breaking the threaded stem, which comprises a female thread portion adapted to be screwed to said threaded stem, wherein the spacer further includes a slip preventing element for protecting the tiles between which the spacer is arranged, adapted to be arranged substantially coaxially to said knob between said knob and said spacing protrusions, for abutment against said knob on a side of said base in a configuration for use.

2. The leveling spacer according to claim 1, wherein rotation-preventing means are defined between said slip preventing element and said base and are adapted to prevent the rotation of said slip preventing element with respect to said base.

3. The leveling spacer according to claim 2, wherein said slip preventing element is constituted by a flat body whose dimensions affect all surface regions of the knob intended to make contact with an underlying tile, an opening being defined in said flat body and being contoured in order to be mated with a corresponding stem supporting portion that extends from said base.

4. The leveling spacer according to claim 3, wherein said rotation preventing means are constituted by said mating between said opening and said stem supporting portion.

5. The leveling spacer according to claim 3, wherein said flat body is a disk and has a perimetric centering shoulder for correct positioning with respect to said knob in a configuration for use.

6. The leveling spacer according to claim 3, wherein said stem supporting portion comprises a number of arc portions for supporting the threaded stem that matches the number of spacing protrusions, each supporting arc portion extending from a corresponding spacing protrusion.

7. The leveling spacer according to claim 3, wherein said opening has curves that extend radially and are each adapted to partially surround an outer profile of a corresponding supporting arc portion.

8. The leveling spacer according to claim 1, wherein said slip preventing element is made of a plastic material.

* * * * *